US009797625B2

(12) United States Patent
Chen

(10) Patent No.: US 9,797,625 B2
(45) Date of Patent: Oct. 24, 2017

(54) FEED WATER HEATER WITH RECOVERY DEVICE FOR SWELLING WATER

(71) Applicant: Yi-Huang Chen, Taichung (TW)

(72) Inventor: Yi-Huang Chen, Taichung (TW)

( * ) Notice: Subject to any disclaimer, the term of this patent is extended or adjusted under 35 U.S.C. 154(b) by 35 days.

(21) Appl. No.: 14/946,154

(22) Filed: Nov. 19, 2015

(65) Prior Publication Data

US 2016/0178238 A1 Jun. 23, 2016

(30) Foreign Application Priority Data

Dec. 22, 2014 (TW) ..... 103222654 U

(51) Int. Cl.

| | |
|---|---|
| ***F24H 1/18*** | (2006.01) |
| ***F24H 9/12*** | (2006.01) |
| ***F24D 17/00*** | (2006.01) |
| ***F24H 9/14*** | (2006.01) |

(52) U.S. Cl.

CPC ..... *F24H 9/124* (2013.01); *F24D 17/0078* (2013.01); *F24D 17/0089* (2013.01); *F24H 1/188* (2013.01); *F24H 9/14* (2013.01)

(58) Field of Classification Search

CPC ..... F24D 17/0089; F24H 1/188; F24H 9/124; F24H 9/14

See application file for complete search history.

(56) References Cited

U.S. PATENT DOCUMENTS

| | | | | |
|---|---|---|---|---|
| 3,891,124 | A * | 6/1975 | Dreibelbis | F24D 17/00 222/108 |
| 4,263,498 | A * | 4/1981 | Meyers | F24H 1/188 137/205.5 |
| 4,424,767 | A * | 1/1984 | Wicke | F16B 7/0413 122/13.3 |
| 4,513,887 | A * | 4/1985 | Wicke | F16B 7/0413 222/146.5 |
| 6,094,524 | A * | 7/2000 | Riley | F24H 1/188 392/441 |
| 6,847,782 | B1 * | 1/2005 | Kovacs | F24H 1/202 392/441 |
| 2007/0044736 | A1 * | 3/2007 | DeSantis | F24H 1/188 122/19.1 |
| 2012/0051725 | A1 * | 3/2012 | Chen | F24D 17/0089 392/443 |
| 2013/0105513 | A1 * | 5/2013 | Krause | B67D 1/0858 222/69 |

FOREIGN PATENT DOCUMENTS

| | | | | |
|---|---|---|---|---|
| GB | 2458826 | A * | 10/2009 | F24D 3/1008 |

* cited by examiner

*Primary Examiner* — Kevin Murphy
(74) *Attorney, Agent, or Firm* — Ming Chow; Sinorica, LLC

(57) ABSTRACT

A heater with a recovery device for swelling water is provided. A water inlet pipe and a water outlet pipe are longitudinally provided on the heater. The recovery device is transversely disposed on the heater and connected with the water inlet pipe, such that the recovery device is coupled on to reduce the entire size. The recovery device is adapted to recycle and store the swelling hot water in the heater so as to provide an energy-saving effect and to stop water from dripping.

6 Claims, 10 Drawing Sheets

FEED WATER HEATER WITH RECOVERY DEVICE FOR SWELLING WATER

The current application claims a foreign priority to application number 103222654 filed on Dec. 22, 2014 in Taiwan.

BACKGROUND OF THE INVENTION

1. Field of the Invention

The present invention relates to an energy-saving device, and more particularly to a feedwater heater with a recovery device for swelling water.

2. Description of the Prior Art

FIG. 1 is a schematic view showing the system arrangement of a conventional feedwater heater. The feedwater heater has a heating container 1. The heating container 1 is connected with a water inlet pipe 2 and a water outlet pipe 3. The water inlet pipe 2 is connected to a water outlet valve 5 of a faucet 4. The water outlet pipe 3 is connected to a water outlet 6 of the faucet 4. When the water outlet valve 5 is opened by the user, the cold water in the water inlet pipe 2 will flow into the heating container 1 to be heated by the heating container 1. Afterward, the hot water flows out through the water outlet pipe 3 for use.

However, when the water outlet valve 5 is closed by the user, the hot water and the steam in the heating container 1 will rise due to the principle of thermal expansion as well as rising of hot air, which causes the water outlet 6 of the faucet 4 to drip water easily. Besides, the hot energy in the heating container 1 may lose. When the user wants to get hot water next time, the heating container 1 will carry out the heating operation again. This consumes energy very much and is not environmental-friendly. Accordingly, the inventor of the present invention has devoted himself based on his many years of practical experiences to solve these problems.

SUMMARY OF THE INVENTION

The primary object of the present invention is to provide a feedwater heater with a recovery device for swelling water. The heater comprises a heating container. The bottom of the heating container is provided with a heating pipe. A water inlet pipe and a water outlet pipe are provided on the heating container. The recovery device is connected to the water inlet pipe. The water inlet pipe and the water outlet pipe are longitudinally disposed above the heating container. The water inlet pipe is provided with a first coupling member thereon. The first coupling member is transversely provided with a first passage. The first passage communicates with the water inlet pipe. The recovery device is transversely disposed above the heating container and provided with a second coupling member corresponding to the first coupling member. The first coupling member is coupled with the second coupling member, enabling the recovery device to be fixed on the water inlet pipe of the heater. The second coupling member is transversely provided with a second passage corresponding to the first passage. The first passage communicates with the second passage. The second passage communicates with the interior of the recovery device.

When the water outlet pipe of the heater is opened, the cold water in the water inlet pipe will pass through the first passage quickly and the air in the recovery device will be sucked out to form a vacuum. When the water outlet pipe is closed, the recovery device sucks the hot water in the heating container and the rising steam, enabling the heating container to form negative pressure to stop the water outlet pipe from dripping water so as to provide an energy-saving effect.

DETAILED DESCRIPTION OF THE PREFERRED EMBODIMENTS

Embodiments of the present invention will now be described, by way of example only, with reference to the accompanying drawings.

Figure 1:
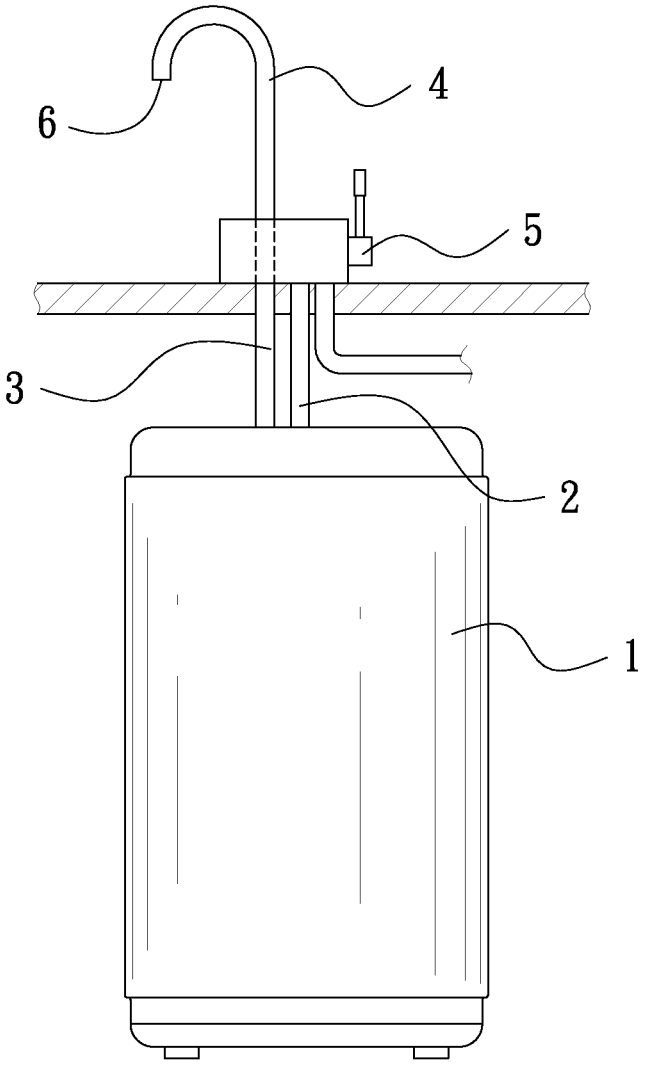
FIG. 1 PRIOR ART
FIG. 1 is a schematic view showing the system arrangement of a conventional feedwater heater.
Figure 2:
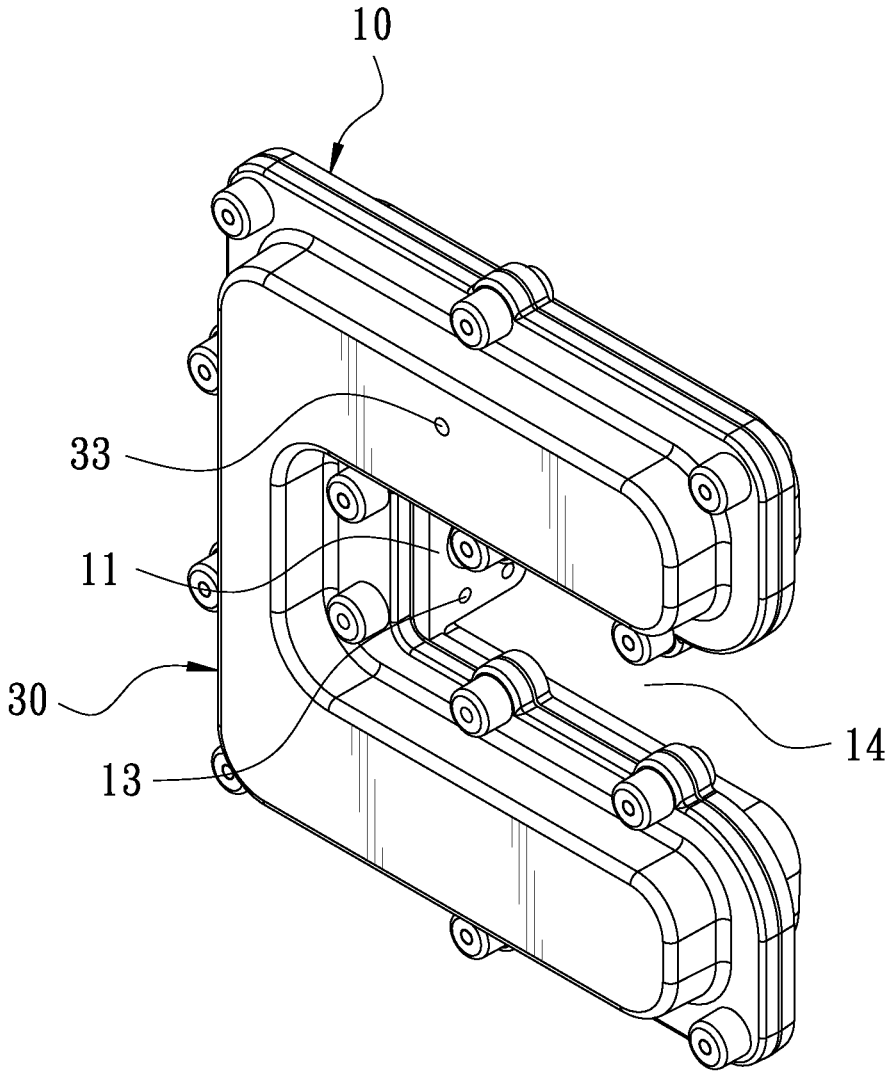
FIG. 2 is a perspective view of the present invention.
Figure 3:
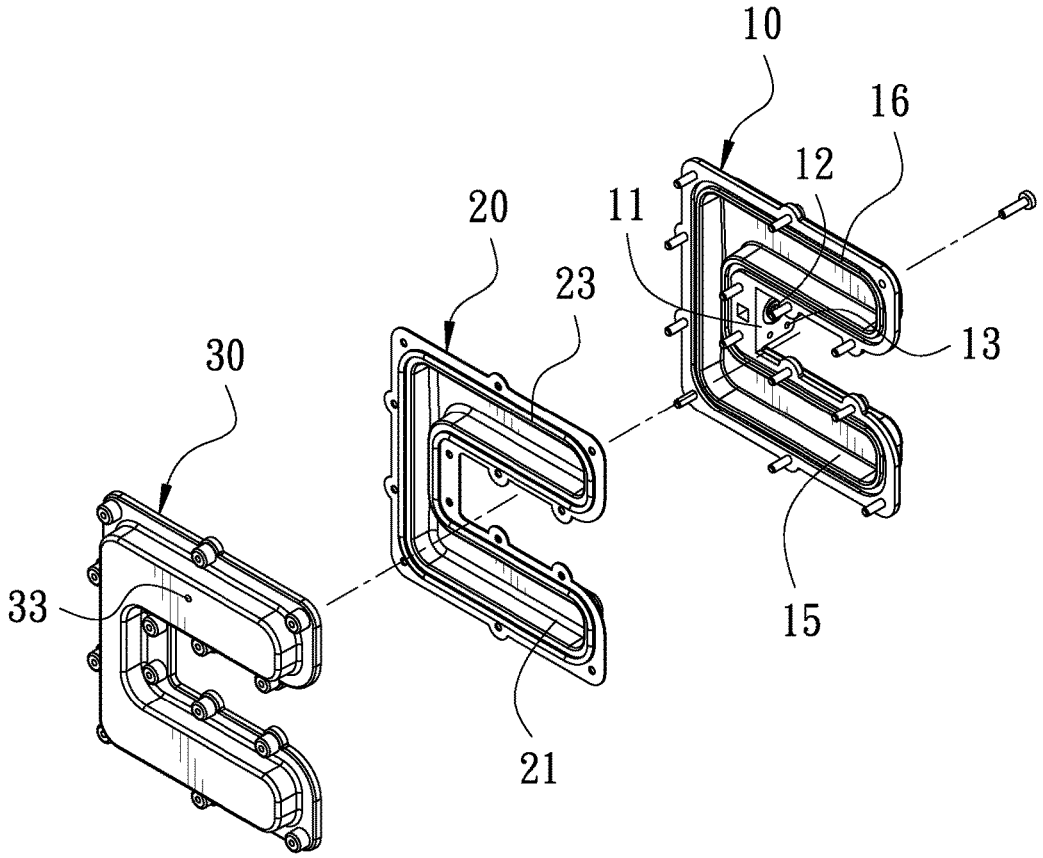
FIG. 3 is an exploded view of the present invention.
Figure 4:
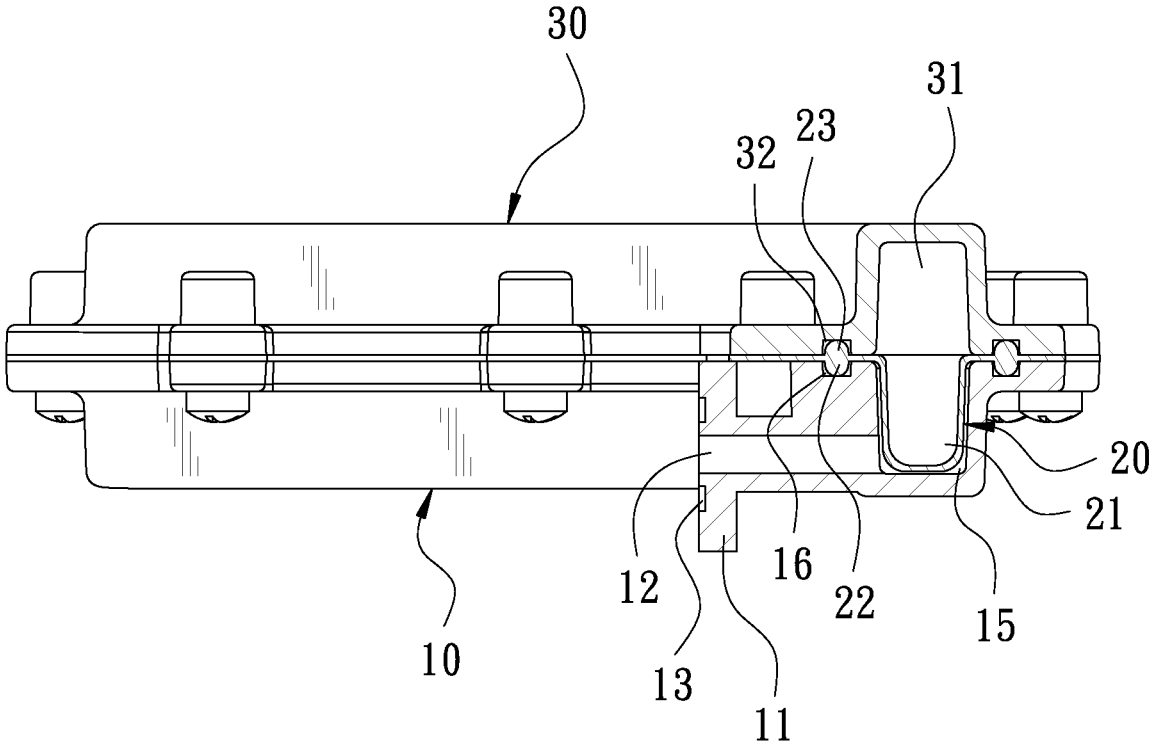
FIG. 4 is a sectional view of the present invention.
Figure 5:
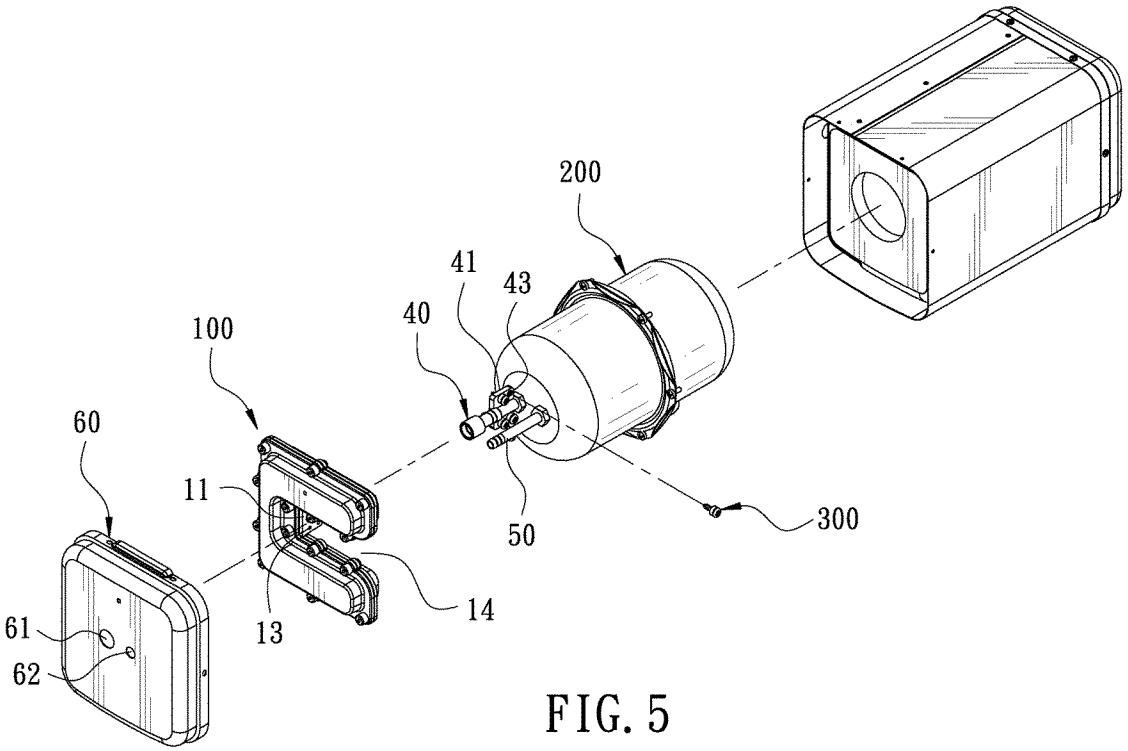
FIG. 5 is a schematic view showing the assembly of the present invention.
Figure 6:
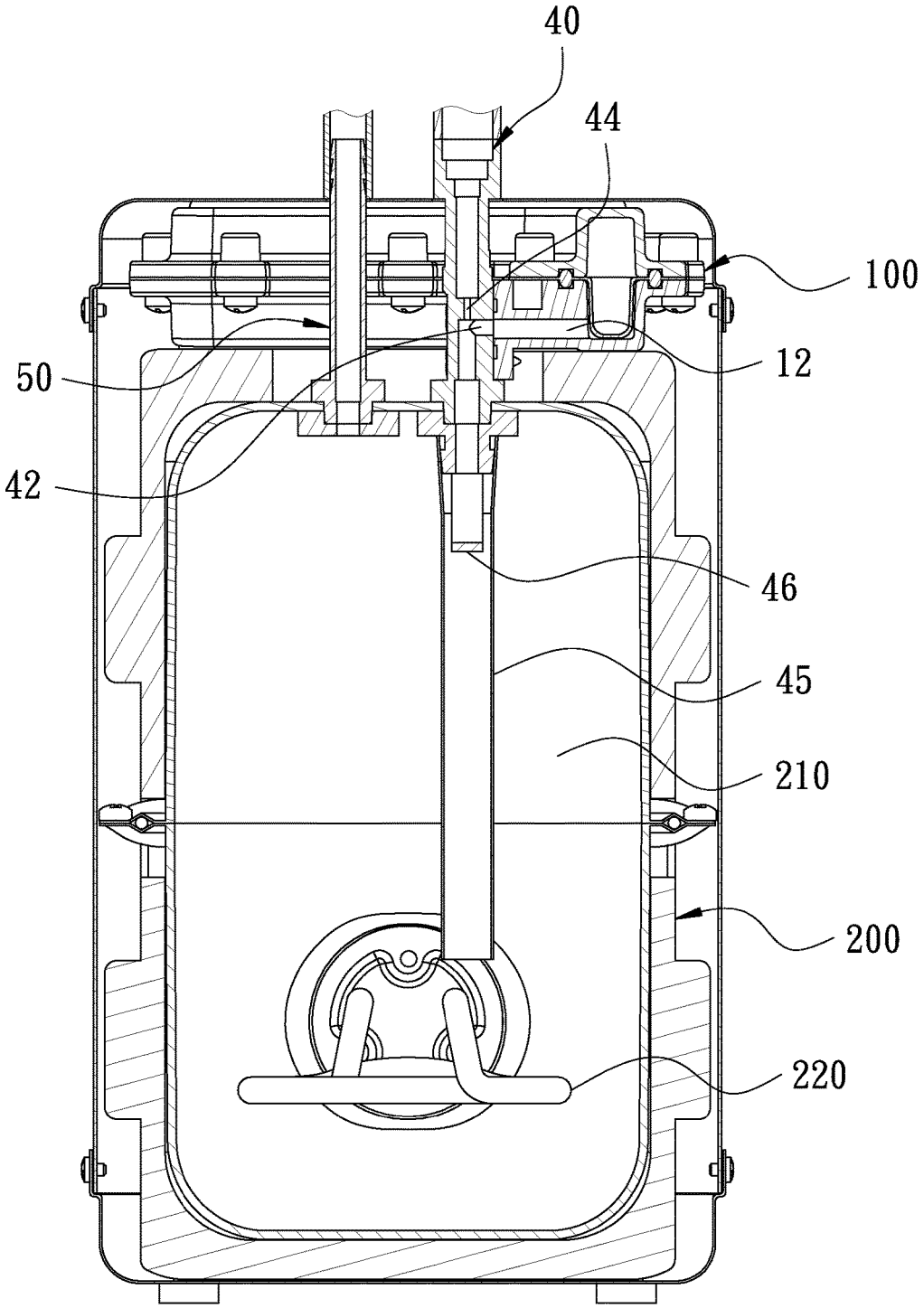
FIG. 6 is a schematic view of the present invention when in use.

FIG. 2 is a perspective view of the present invention. FIG. 3 is an exploded view of the present invention. FIG. 4 is a sectional view of the present invention. FIG. 5 is a schematic view showing the assembly of the present invention. FIG. 6 is a schematic view of the present invention when in use. The present invention discloses a feedwater heater 200 with a recovery device 100 for swelling water. The heater 200 comprises a heating container 210. The bottom of the heating container 210 is provided with a heating pipe 220. A water inlet pipe 40 and a water outlet pipe 50 are provided on the heating container 210. The recovery device 100 is connected to the water inlet pipe 40.

The water inlet pipe 40 and the water outlet pipe 50 are longitudinally disposed above the heating container 210. The water inlet pipe 40 is provided with a first coupling member 41 thereon. The first coupling member 41 is a longitudinal board formed with a plurality of locking holes 43. The first coupling member 41 is transversely provided with a first passage 42. The first passage 42 communicates with the water inlet pipe 40. The water inlet pipe 40 is formed with a narrow section 44 above the first passage 42. The narrow section 44 has a pipe diameter less than that of the water inlet pipe 40 and the first passage 42. A lower end of the water inlet pipe 40 is further connected with an extension pipe 45. A lower edge of the extension pipe 45 is close to the heating pipe 220. A central portion of the extension pipe 45 is transversely provided with a stopper 46 for stopping water current. The area of the stopper 46 is slightly less than the cross-section of the extension pipe 45, such that an interval is formed between the stopper 46 and the inner wall of the extension pipe 45 for the water current to pass therethrough so as to buffer the water current.

The recovery device 100 is transversely disposed above the heating container 210 and provided with a second coupling member 11 corresponding to the first coupling member 41. The first coupling member 41 is coupled with the second coupling member 11, enabling the recovery device 100 to be fixed on the water inlet pipe 40 of the heater 200. The second coupling member 11 is also a longitudinal board formed with a plurality of locking holes 13 corresponding to the locking holes 43 of the first coupling member 41 for a plurality of locking members 300 to lock the first coupling member 41 and the second coupling member 11. The second coupling member 11 is transversely provided with a second passage 12 corresponding to the first passage 42. The first passage 42 communicates with the second passage 12, and the second passage 12 communicates with the interior of the recovery device 100. In this embodiment, the recovery device 100 has a U shape formed with a longitudinal hollow portion 14 at a central section thereof for the water inlet pipe 40 and the water outlet pipe 50 to pass therethrough. The recovery device 100 is composed of an upper casing 30 and a lower casing 10. A pressure membrane 20 is provided between the upper casing 30 and the lower casing 10. The lower casing 10 is formed with a storage trough 15 and a first limit groove 16 around an outer edge of the storage trough 15. The pressure membrane 20 is made of a soft material, such as rubber, PU (Polyurethane), and the like. One side of the pressure membrane 20, facing the lower casing 10, is formed with a concave trough 21 and a first limit protrusion 22 disposed around the concave trough 21 and corresponding to the first limit groove 16 of the lower casing 10 to seal the storage trough 15 of the lower casing 10. Another side of the pressure membrane 20, corresponding to the first limit protrusion 22, is further provided with a second limit protrusion 23. The upper casing 30 is formed with a balance trough 31 and a second limit groove 32 disposed around the balance trough 31 and corresponding to the second limit protrusion 23 of the pressure membrane 20 to seal the side of the pressure membrane 20. Furthermore, the upper casing 30 is formed with an air hole 33 communicating with the balance trough 31.

The recovery device 100 further comprises an outer cover 60 to fit on the recovery device 100. The outer cover 60 has two through holes 61, 62 for insertion of the water inlet pipe 40 and the water outlet pipe 50, such that the recovery device 100 is combined with the heater 200.

Figure 7:
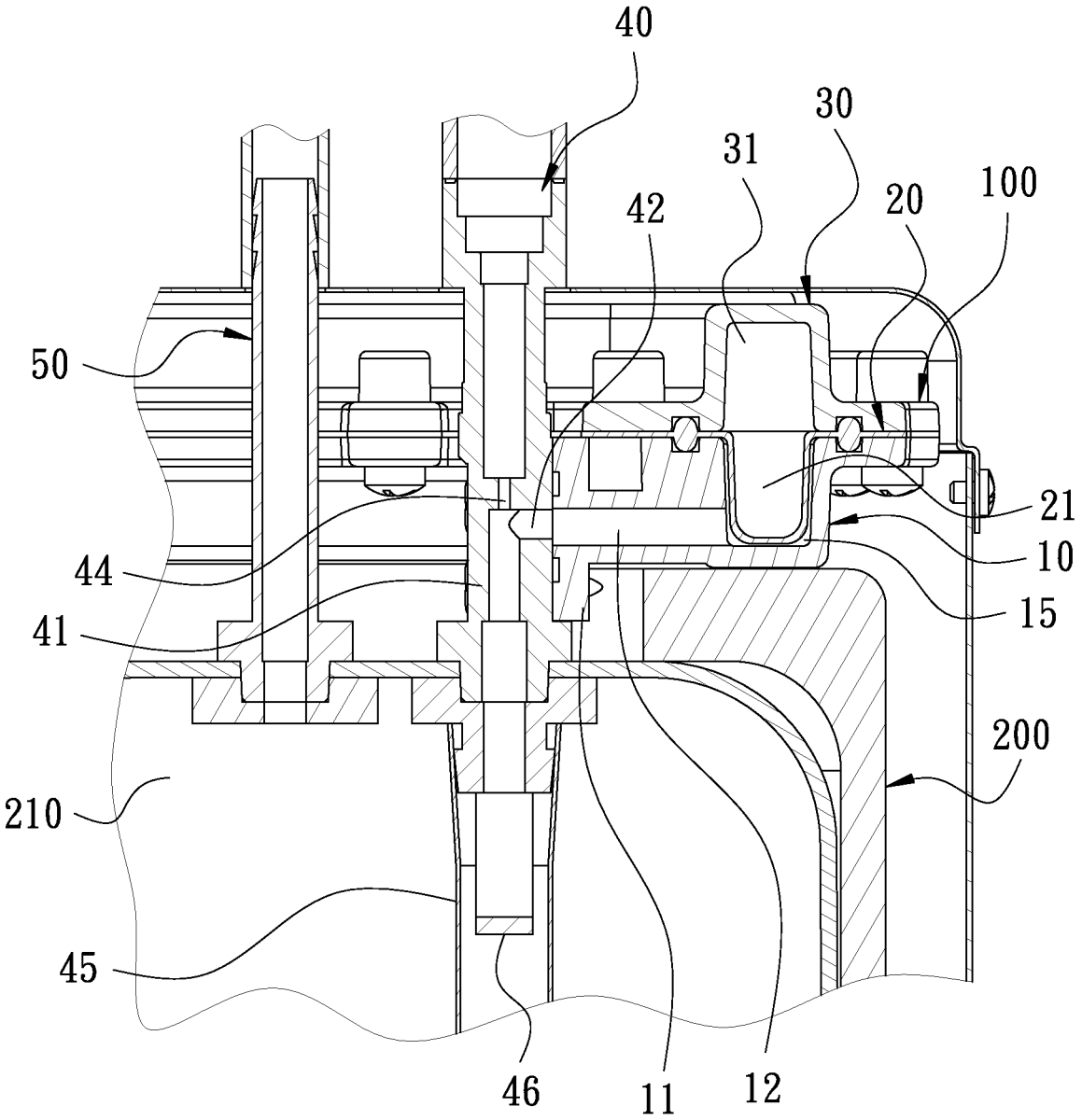
FIG. 7 is a partial schematic view of the present invention when in use.

FIG. 5 is a schematic view showing the assembly of the present invention. FIG. 6 is a schematic view of the present invention when in use. FIG. 7 is a partial schematic view of the present invention when in use. The recovery device 100 is transversely disposed on the heater 200. The water inlet pipe 40 and the water outlet pipe 50 pass through the hollow portion 14 of the recovery device 100, enabling the recovery device 100 to be placed on the heater 200 totally. Through the first coupling member 41 of the water inlet pipe 40 to connect the second coupling member 11 of the recovery device 100, the recovery device 100 is tightly coupled to the heater 200. Thereby, the first passage 42 of the first coupling member 41 communicates with the second passage 12 of the second coupling member 11, such that the recovery device 100 communicates with the water inlet pipe 40 of the heater 200 and the recovery device 100 is combined with the heater 20 so as to reduce the entire volume greatly and to decrease the space occupied.

Figure 8:
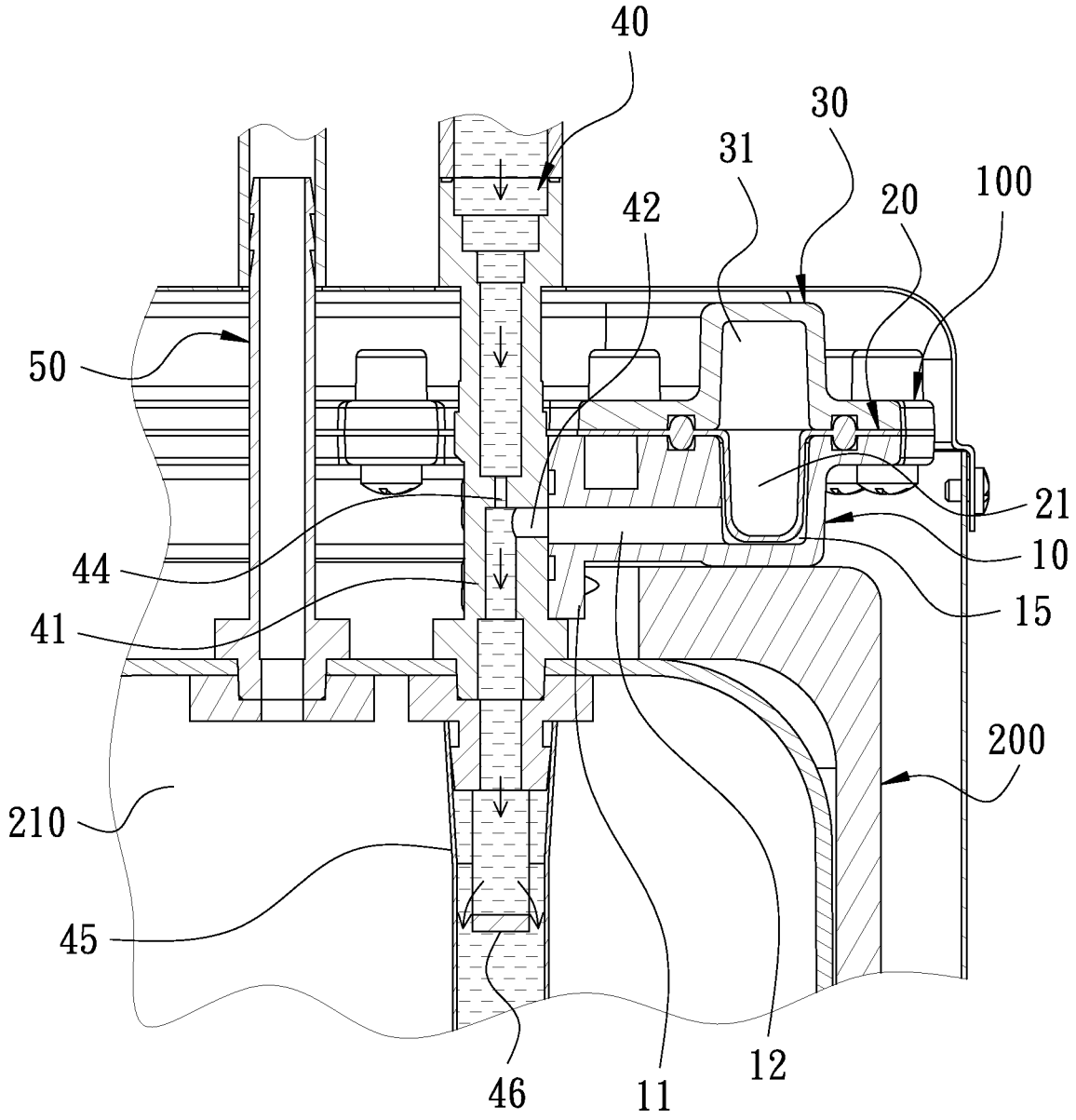
FIG. 8 is a schematic view of the operation of the present invention, showing the heater in an inflow state.
Figure 9:
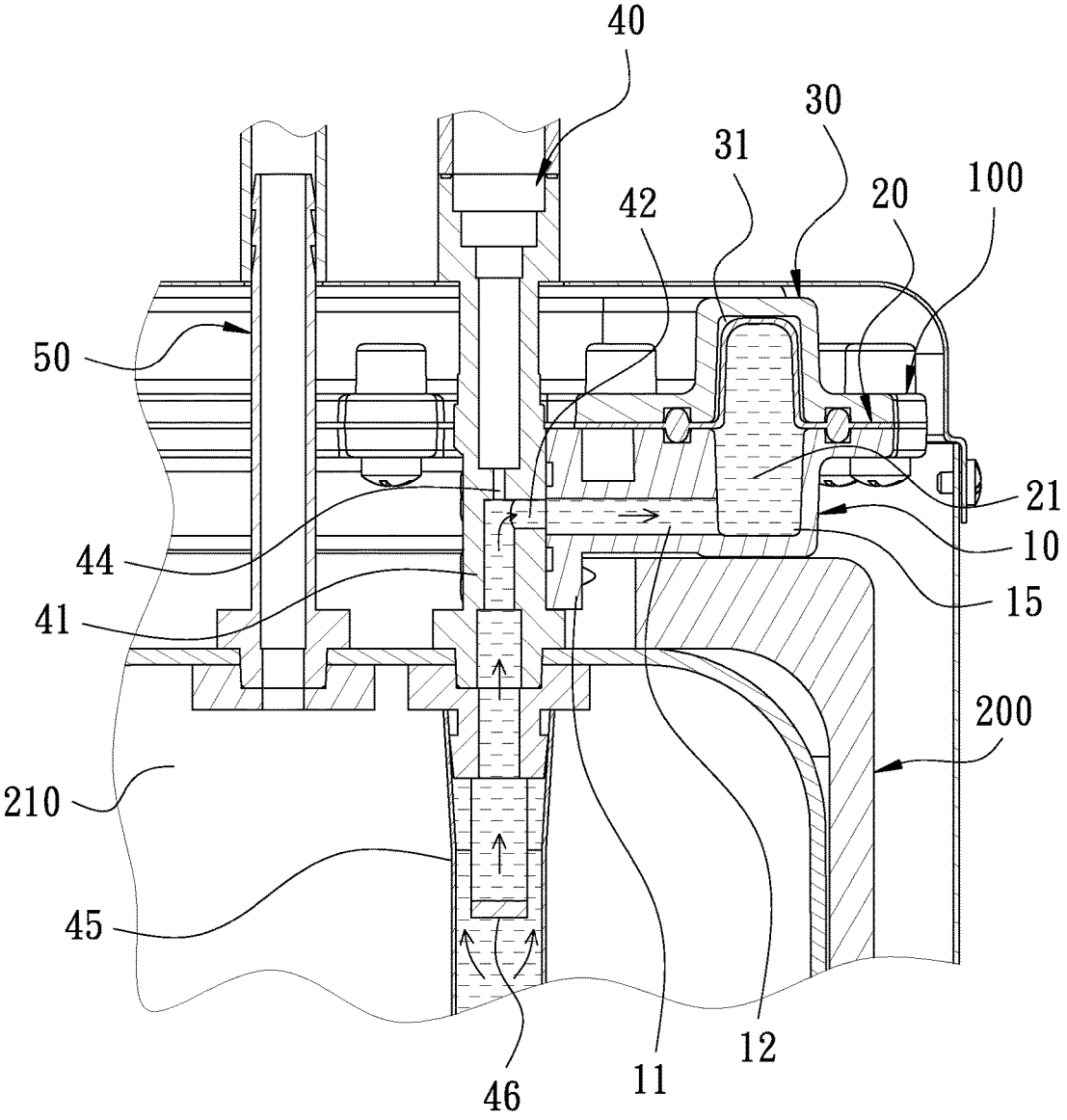
FIG. 9 is a schematic view of the operation of the present invention, showing the heater in a heating state.
Figure 10:
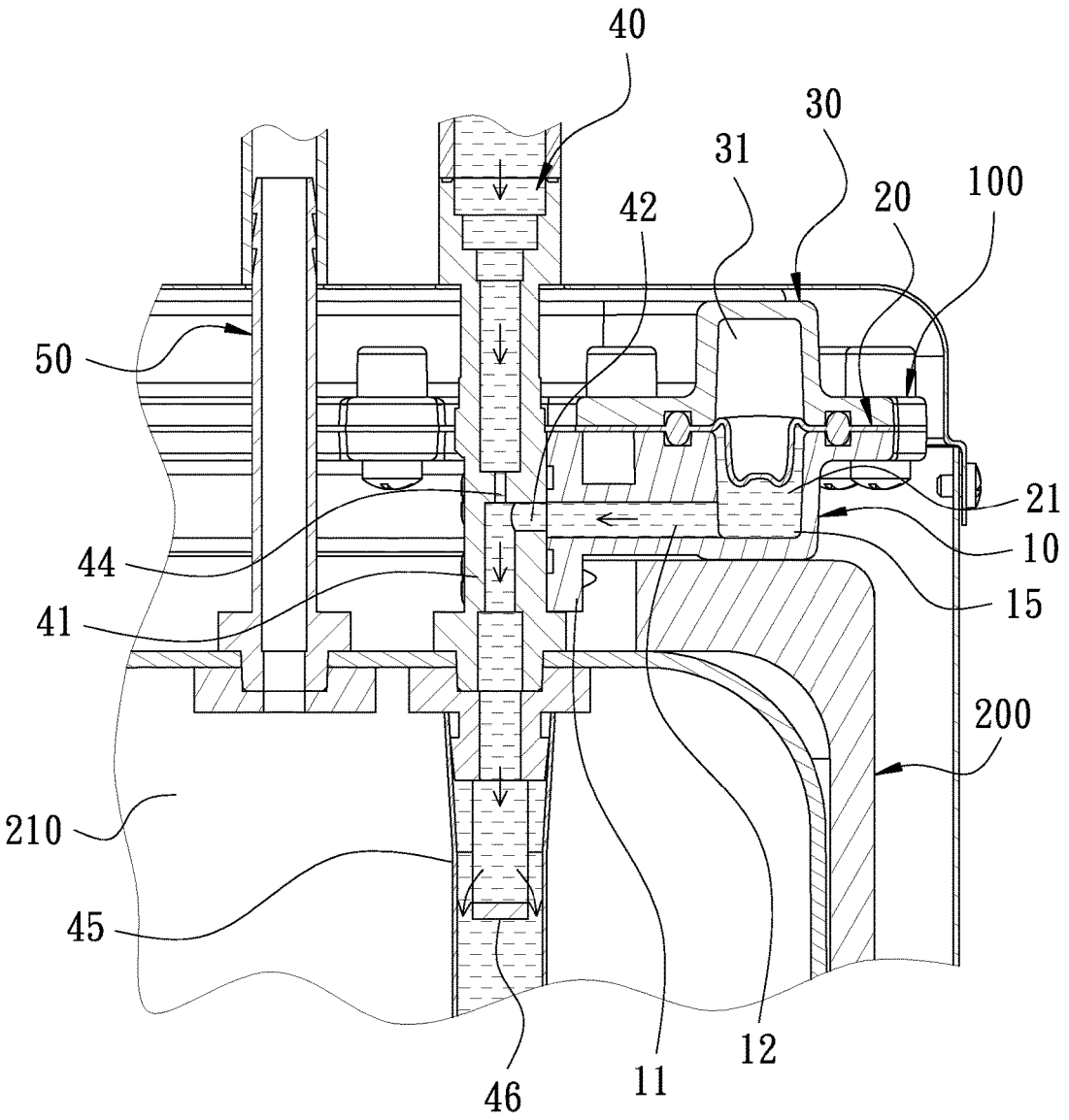
FIG. 10 is a schematic view of the operation of the present invention, showing the heater in a water supply state.

FIG. 8 is a schematic view of the operation of the present invention, showing the heater in an inflow state. FIG. 9 is a schematic view of the operation of the present invention, showing the heater in a heating state. FIG. 10 is a schematic view of the operation of the present invention, showing the heater in a water supply state. Referring to FIG. 3 and FIG. 7, when the water outlet pipe 50 of the heater 200 is to output water, the cold water in the water inlet pipe 40 will flow quickly. Because the water inlet pipe 40 has the narrow section 44 above the first passage 42, the water current generates an acceleration effect to form negative pressure when passing the narrow section 44 and the air between the pressure membrane 20 and the storage trough 15 is brought away through the first passage 42 and the second passage 12, enabling the storage space defined between the storage trough 15 and the pressure membrane 20 to form a vacuum. The pressure membrane 2 is shrunk and deformed in the direction of the lower casing 10. The external air enters the balance trough 31 through the air hole 33 of the upper casing 30 to balance the air pressure. After that, when the water outlet pipe 50 stops outputting water, the water current stops running and the negative pressure disappears. The pressure membrane 2 is deformed in the direction of the upper casing 30. During deformation, the pressure membrane 2 sucks the hot water in the heating container 210 by heating and the rising steam, such that the heating container 210 is formed with negative pressure to stop the water outlet pipe 50 from dripping water and to prevent the heat energy in the heating container 210 from losing, providing an energy-saving effect. Because heat makes hot water expand and cold makes it contract to reduce the volume, the pressure membrane 20 sucks more water when restored to increase the negative pressure in the heating container 210. This enhances the dripless and energy-saving effects of the recovery device of the heater greatly.

It is noted that when the heater 200 heats the water in the heating container 210, the steam by hating will pass through the water inlet pipe 40, the first passage 42, and the second passage 12 in sequence to be delivered to the storage space between the storage trough 15 and the pressure membrane 20 so as to retrieve the steam energy. The temperature of the water stored in the storage space between the storage trough 15 and the pressure membrane 20 can be kept so as to shorten the time to heat the water in the heating container 210 effectively.

It is noted that the stopper 46 provided in the extension pipe 45 makes the water in the water inlet pipe 40 flush the stopper 46 first and then pass through the interval between the stopper 46 and the inner wall of the extension pipe 45 to flow into the heating container 210. This avoids the water current of the water inlet pipe 40 from flushing the heating container 210 directly to cause that the temperate of the water in the heating container 210 drops drastically and that the heating pipe 220 is heated repeatedly to waste energy.

The features and expected effects of the recovery device of the feedwater heater of the present invention are described as follows:

1. When the heater 200 heats the water in the heating container 210, the steam generated by hating can be recycled and stored in the storage space between the storage trough 15 and the pressure membrane 20 as to retrieve the steam energy. The temperature of the water stored in the storage space between the storage trough 15 and the pressure membrane 20 can be kept so as to shorten the time to heat the water in the heating container 210 effectively.

2. When the water outlet valve of the water outlet pipe 50 is closed, the pressure membrane 2 sucks the hot water in the heating container 210 to the storage trough 15, enabling the heating container 210 to form negative pressure to stop the water outlet pipe 50 from dripping water and to prevent the heat energy in the heating container 210 from losing so as to provide an energy-saving effect.

3. The recovery device 100 is coupled on the heater 20 to reduce the entire volume greatly and to decrease the space occupied.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A heater comprising:

a heating container;

a heating pipe;

a water inlet pipe;

a water outlet pipe;

a recovery device;

the heating container comprising a heating chamber;

the water inlet pipe comprising a water inlet chamber;

the water outlet pipe comprising a water outlet chamber;

the recovery device comprising an interior;

the heating pipe being accommodated within the heating chamber and disposed adjacent to a bottom of the heating container;

the water inlet pipe and the water outlet pipe being connected to the heating container;

the recovery device being connected to the water inlet pipe;

the water inlet pipe and the water outlet pipe being longitudinally disposed above the heating container;

the heating chamber being communicated with the water outlet chamber;

a first coupling member;

the first coupling member being connected to the water inlet pipe;

the first coupling member comprising a first passage transversely provided therewith;

the first passage being communicated with the water inlet chamber;

the recovery device being transversely disposed above the heating container;

a second coupling member;

the second coupling member being connected to the recovery device;

the second coupling member corresponding to the first coupling member;

the first coupling member being coupled with the second coupling member, enabling the recovery device to be fixed on the water inlet pipe;

the second coupling member comprising a second passage transversely provided therewith;

the second passage corresponding to the first passage;

the first passage being communicated with the second passage;

the second passage being communicated with the interior;

the recovery device comprising an upper casing and a lower casing;

the upper casing and the lower casing being connected to each other so as to form the interior;

a pressure membrane;

the pressure membrane being made of a soft material;

the pressure membrane being sandwiched in between the upper casing and the lower casing;

the lower casing comprising a storage trough and a first limit groove;

the first limit groove surrounding the storage trough;

the pressure membrane comprising a concave trough, a first limit protrusion and a second limit protrusion;

the first limit protrusion surrounding the concave trough;

the first limit protrusion being inserted into the first limit groove so as to seal the storage trough;

the second limit protrusion corresponding to the first limit protrusion;

the upper casing comprising a balance trough, a second limit groove and an air hole;

the air hole being communicated with the balance trough;

the concave trough and the balance trough jointly forming the interior;

the second limit groove surrounding the balance trough;

the second limit protrusion being inserted into the second limit groove so as to seal the balance trough;

the concave trough being operatively accommodated within the storage trough or the balance trough;

the first coupling member comprising a first longitudinal board and a plurality of first locking holes formed on the first longitudinal board;

the second coupling member comprising a second longitudinal board and a plurality of second locking holes formed on the second longitudinal board;

the second locking hole corresponding to the first locking hole;

a plurality of locking members; and the locking member penetrating through the first locking hole and the second locking hole so as to lock the first coupling member with the second coupling member.

2. The heater as claimed in claim 1 comprising:

the recovery device comprising a U shape formed with a longitudinal hollow portion at a central section thereof for the water inlet pipe and the water outlet pipe to pass therethrough.

3. The heater as claimed in claim 1 comprising:

an outer cover;

the outer cover being fitted on the recovery device;

the outer cover comprising two through holes;

the water inlet pipe penetrating through one of the two through holes; and the water outlet pipe penetrating through the other one of the two through holes.

4. The heater as claimed in claim 1 comprising:

the water inlet chamber comprising a narrow section and a remaining section;

the narrow section being formed above the first passage;

the water inlet chamber comprising a first inlet diameter located at the narrow section and a second inlet diameter located at the remaining section;

the first passage comprising a passage diameter; and the first inlet diameter being less than the second inlet diameter and the passage diameter.

5. The heater as claimed in claim 1 comprising:

an extension pipe;

the extension pipe being connected to a lower end of the water inlet pipe;

the extension pipe being accommodated within the heating chamber; and a lower edge of the extension pipe being adjacent to the heating pipe.

6. The heater as claimed in claim 5 comprising:

a stopper;

the stopper being accommodated within the extension pipe and transversely located at a central portion of the extension pipe for stopping water current;

the stopper comprising an area slightly less than a cross-section of the extension pipe so as to form an interval in between the stopper and an inner wall of the extension pipe; and the stopper buffering the water current in response to the water current passing through the interval.

* * * * *